US012478152B1

(12) United States Patent
Luo

(10) Patent No.: US 12,478,152 B1
(45) Date of Patent: Nov. 25, 2025

(54) ROD WITH A LIGHT MECHANISM AND AN UMBRELLA THEREOF

(71) Applicant: Tempo Manufacturing LLC, Jiangsu (CN)

(72) Inventor: Xiong Luo, Nantong (CN)

(73) Assignee: Tempo Manufacturing LLC, Nantong (CN)

( * ) Notice: Subject to any disclaimer, the term of this patent is extended or adjusted under 35 U.S.C. 154(b) by 0 days.

(21) Appl. No.: 19/077,325

(22) Filed: Mar. 12, 2025

(30) Foreign Application Priority Data

Dec. 30, 2024 (CN) ..... 202411958888.X

(51) Int. Cl.

| | |
|---|---|
| ***A45B 3/04*** | (2006.01) |
| ***A45B 25/02*** | (2006.01) |
| *A45B 23/00* | (2006.01) |
| *E04H 15/10* | (2006.01) |

(52) U.S. Cl.
CPC ..... *A45B 3/04* (2013.01); *A45B 25/02* (2013.01); *A45B 2023/0006* (2013.01); *A45B 2023/0056* (2013.01); *A45B 2200/1018* (2013.01); *E04H 15/10* (2013.01)

(58) Field of Classification Search
CPC ... A45B 3/04; A45B 25/02; A45B 2023/0006; A45B 23/0056; A45B 2200/1018; E04H 15/10; F21Y 2103/10; F21S 4/28
See application file for complete search history.

(56) References Cited

U.S. PATENT DOCUMENTS

| | | | | |
|---|---|---|---|---|
| 10,646,011 | B2 * | 5/2020 | Wei | A45B 25/18 |
| 11,982,414 | B2 * | 5/2024 | Xue | F21V 15/015 |
| 2018/0073719 | A1 * | 3/2018 | Bliss | F21V 3/00 |
| 2019/0338550 | A1 * | 11/2019 | Zhu | F21V 33/006 |
| 2022/0057055 | A1 * | 2/2022 | Findlay | F21V 15/015 |
| 2023/0400166 | A1 * | 12/2023 | Yeo | F21V 13/04 |
| 2024/0041170 | A1 * | 2/2024 | Ke | A45B 25/02 |

FOREIGN PATENT DOCUMENTS

| | | | | |
|---|---|---|---|---|
| CN | 116548713 A | * | 8/2023 | F21V 33/0004 |
| WO | WO-2023131526 | * | 7/2023 | F21V 5/007 |

* cited by examiner

*Primary Examiner* — Zheng Song
(74) *Attorney, Agent, or Firm* — Wang Law Firm, Inc.

(57) ABSTRACT

An umbrella having rods each with a light mechanism comprises a column, one or more nests and a plurality of rods or comprises a plurality of supporting columns and a plurality of rods. The rod with a light mechanism comprises a rod, a lampshade and a light-emitting assembly and two sealing plugs respectively disposed at the front end and the rear end of the lampshade. The rod has an inner chamber for receiving the lampshade. The rod has an opening at a bottom of the inner chamber extending lengthwise along the rod and allowing light of the light-emitting assembly to emit. The light-emitting assembly comprises two light-emitting elements, a reflective film and a light-guiding strip. The reflective film is attached to a back surface of the light-guiding strip and the two light-emitting elements are respectively disposed at the front end and the rear end of the light-guiding strip.

9 Claims, 7 Drawing Sheets

ROD WITH A LIGHT MECHANISM AND AN UMBRELLA THEREOF

TECHNICAL FIELD OF THE INVENTION

The present invention relates to a field of umbrellas, and in particular to a rod with a light mechanism and an umbrella thereof.

BACKGROUND OF THE INVENTION

As a kind of outdoor leisure items, umbrellas are widely applied in squares, beaches, parks, gardens or similar places to shield an individual from sun. In order to make umbrellas used outdoor have a lighting function, lamp umbrellas with the lighting function have emerged at present, bringing comfort and convenience to outdoor activities at night in places such as beaches, open-air bars and coffee houses. However, the existing lamp umbrellas are complex in structure, difficult to machine and poor in integrity.

Upon examination, a Chinese application CN114766797A (patent No.: CN202210569865.4) discloses an umbrella with light-guiding strips, comprising light-guiding strips, backlight-guiding strips, a short rod wire connecting plate, a light source wire, a short rod tail wire, a long rod wire connecting plate, a long rod tail wire, and a solar panel and a switch. Each long rod and/or short rod is clamped with the light-guiding strip; each light-guiding strip is connected to the corresponding long rod through a plurality of screws, and each light-guiding strip is connected to the corresponding short rod through a plurality of self-tapping screws. Each short rod is clamped with the back-light-guiding strip, and the backlight-guiding strips are attached to the short rods by a double-sided adhesive tape. The lamp umbrella is simplified in structure and good in integrity. However, the rods need to be slotted, resulting in troubles in machining; moreover, it is also troublesome to assemble the lighting strip, and it is inconvenient for daily maintenance. Thus, further improvements need to be made in structure.

SUMMARY OF THE INVENTION

It is a first object of the present invention to provide a rod with a light mechanism, which is simple and reasonable in structure and convenient to machine and assemble.

It is a second object of the present invention to provide an umbrella having the rods each with the light mechanism, which is simple and reasonable in structure and convenient to machine and assemble.

For achieving the first object, the rod with a light mechanism comprises a hollow rod; a hollow lampshade having a front end and a rear end; a light-emitting assembly running through the lampshade; and two sealing plugs respectively disposed at the front end and the rear end of the lampshade; wherein, the rod has an inner chamber for receiving the lampshade, the rod has an opening at a bottom of the inner chamber extending lengthwise along the rod and allowing light of the light-emitting assembly to emit; the light-emitting assembly comprises two light-emitting elements, a reflective film and a light-guiding strip, the reflective film is attached to a back surface of the light-guiding strip, the two light-emitting elements are respectively disposed at the front end and the rear end of the light-guiding strip.

Preferably, the lampshade is of a strip shape, a width of the lampshade is less than a width of the rod but greater than a width of the opening; a partition plate extending lengthwise along the rod is configured inside the hollow rod to divide the hollow rod into an upper inner chamber and a lower inner chamber which is defined as the inner chamber; the rod has two pairs of left and right ridges respectively disposed at an upper inner wall and a lower inner wall of the lower inner chamber each extending lengthwise along the rod, so as to position the lampshade inside the inner chamber; the lampshade runs through the inner chamber of the rod and a bottom surface of the lampshade is substantially flush with the rod, the lampshade and the rod are mounted together to form a rod assembly.

Preferably, the rod has two edges at a left side and a right side of the opening, the lampshade has two small recesses respectively formed at a left corner and a right corner of the bottom surface of the lampshade for receiving and positioning the two edges of the rod.

Preferably, a longitudinal section of the lampshade is of a rectangular shape, each pair of the left and right ridges is symmetrically disposed at two opposite sides of the opening.

Preferably, the two light-emitting elements are LED lamp beads, the LED lamp beads are disposed on two LED lamp boards which are respectively disposed at the front end and a rear end of the light-guiding strip, the two LED lamp boards are electrically connected with each other.

Preferably, a connector is connected to one of the two LED lamp boards by a wire; the corresponding sealing plug has a slot for allowing the wire to pass through, each sealing plug has a plug board to be inserted into the hollow lampshade.

Preferably, each sealing plug has a glue injection groove at a bottom of the sealing plug; after the two sealing plugs are respectively inserted into the front end and the rear end of the lampshade, the two sealing plugs are sealed with the lampshade by injecting glue.

Preferably, there are at least two sets of the light-guiding strips and the two light-emitting elements.

Preferably, the light-emitting assembly has two sets of the light-guiding strips and the two light-emitting elements, the number of the reflective film is one or two; the two light-guiding strips are sequentially disposed inside the lampshade each extending lengthwise along the lampshade, the reflective films are attached to the back surfaces of the two light-guiding strips, the light-emitting elements are respectively disposed at the front and rear ends of each light-guiding strip; each LED lamp board comprises a front lamp board, a middle lamp board and a rear lamp board, two light-emitting elements located between the two light-guiding strips are disposed at the same middle lamp board, the front lamp board is electrically connected to the middle lamp board by wiring, and the middle lamp board is electrically connected to the rear lamp board by wiring.

Preferably, the rod is formed by extrusion molding of a hollow metal tube, two tube plugs are respectively connected to a front end and a rear end of the rod, the lampshade matches with the rod in length.

For achieving the second object, the umbrella comprises a column, one or more nests and a plurality of rods; wherein each rod has the above-stated light mechanism. Or, the umbrella comprises a plurality of supporting columns and a plurality of rods together forming a canopy frame; wherein each rod has the above-stated light mechanism.

Compared with the prior art, the rod with a light mechanism of the present invention has the following advantages. The rod has the inner chamber for receiving the lampshade, and the light-emitting assembly runs through the lampshade. The lampshade protects the one or more light-guiding strips, the reflective film, the two light-emitting elements and the electrical connection elements, thus avoiding circuit damage. Two sealing plugs respectively disposed at the front end and the rear end of the lampshade so that water vapor can be prevented from entering and damaging the electric parts. Therefore, it is more suitable for outdoor use. There may be one or two light-guiding strips arranged sequentially, the light-emitting elements can be additionally disposed at a middle portion of each light-guiding strip to improve the lighting brightness. The light source is diffused twice by the reflective film and the lampshade, so that the light is more uniform. The rod of the present invention is reasonable in structural design, convenient and quick to assemble or disassemble, and greatly convenient for daily maintenance. Moreover, the lighting effect is better, and the product is more aesthetic and flexible to use and can be applied in different scenarios.

DETAILED DESCRIPTION OF THE INVENTION

Figure 1:
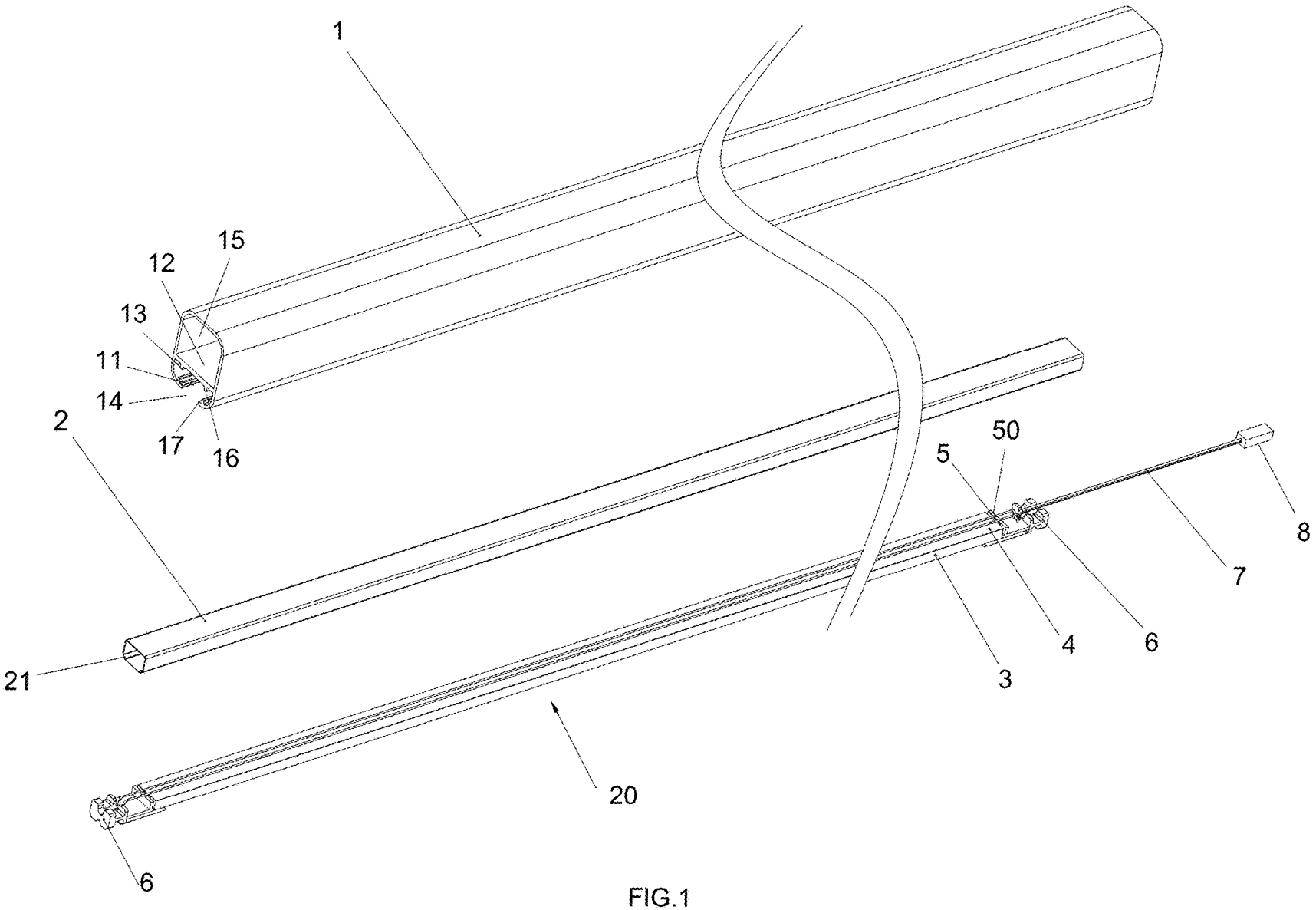
FIG. 1 is an exploded view of a rod with a light mechanism according to Embodiment 1 of the present invention.
Figure 2:
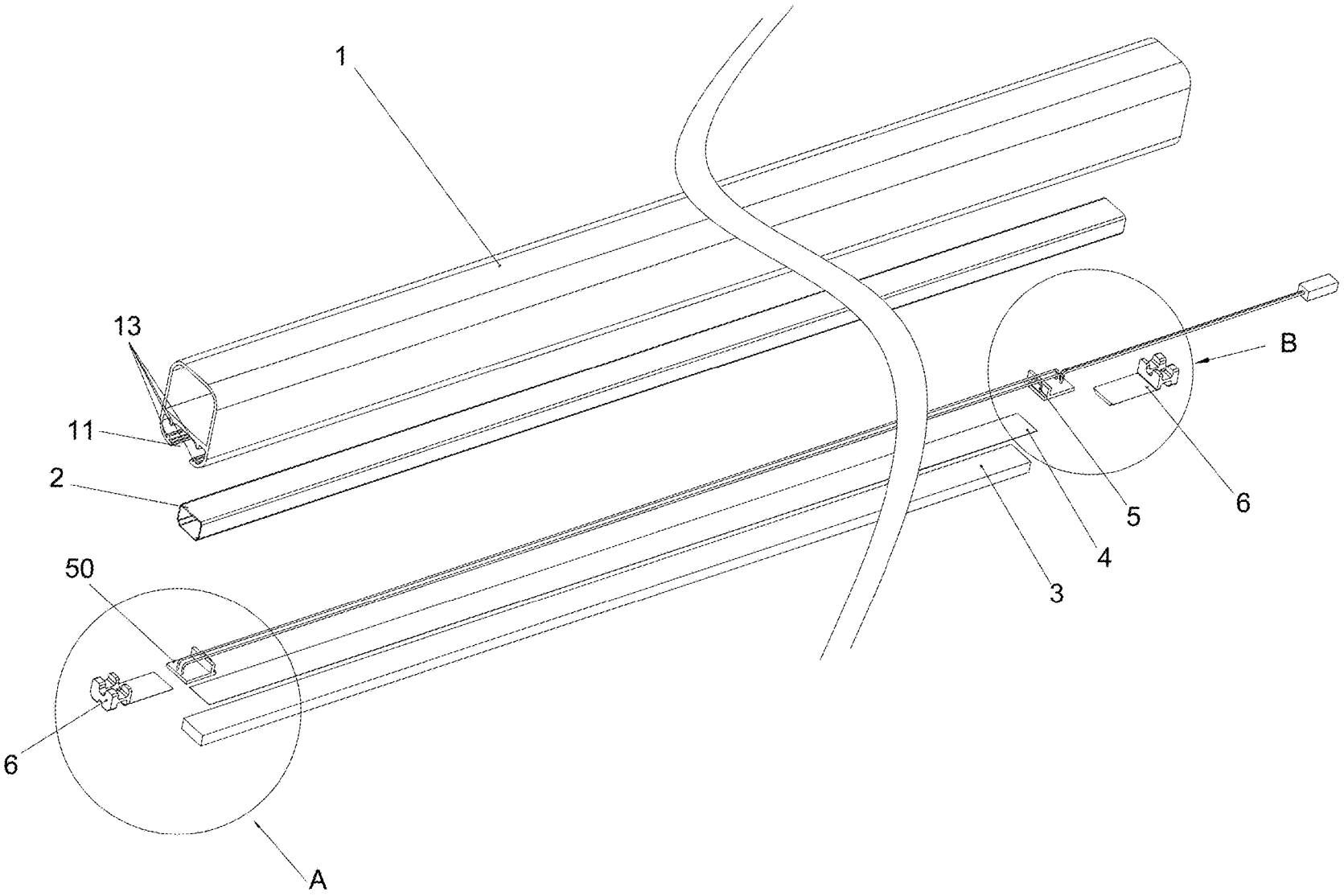
FIG. 2 is another exploded view of the FIG. 1 according to Embodiment 1 of the present invention.
Figure 3:
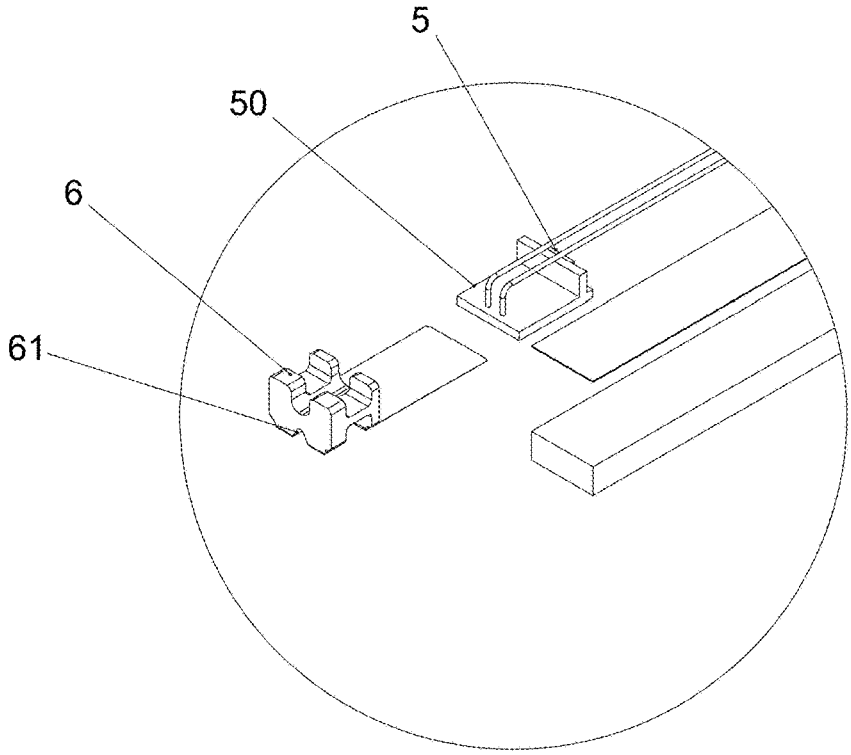
FIG. 3 is an enlarged view of a Part-A in FIG. 2 according to Embodiment 1 of the present invention.
Figure 4:
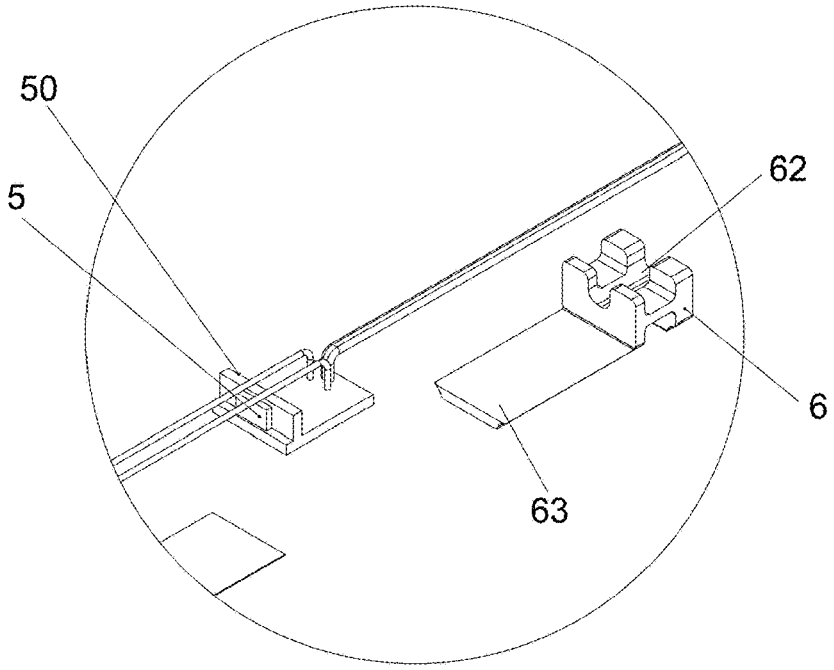
FIG. 4 is an enlarged view of a Part-B in FIG. 2 according to Embodiment 1 of the present invention.

The present invention will be further described below in detail by embodiments with reference to the accompanying drawings.

Embodiment 1

As shown in FIGS. 1-4, the umbrella having the rods each with the light mechanism comprises a column, one or more nests and a plurality of rods 1. Each rod with a light mechanism comprises a hollow rod 1, a hollow lampshade 2 having a front end and a rear end, a light-emitting assembly 20 running through the lampshade 2; and two sealing plugs 6 respectively disposed at the front end and the rear end of the lampshade 2. The rod 1 has an inner chamber 11 for receiving the lampshade 2 and an opening 14 at a bottom of the inner chamber 11 extending lengthwise along the rod 1 and allowing light of the light-emitting assembly 20 to emit. The light-emitting assembly 20 comprises two light-emitting elements 5, a reflective film 4 and a light-guiding strip 3. The reflective film 4 is attached to a back surface of the light-guiding strip 3. There are one reflective film 4, one light-guiding strip 3 and two light-emitting elements 5 in this embodiment. The two light-emitting elements 5 are respectively disposed at the front end and the rear end of the light-guiding strip 3.

Specifically, the rod 1 is formed by extrusion molding of a hollow metal tube. The lampshade 2 is of a strip shape and a longitudinal section of the lampshade 2 is of a rectangular shape. Of course, the longitudinal section of the lampshade 2 can also be oval, circular or in other shapes. The lampshade 2 is the same as or matches with the rod 1 in length. A width of the lampshade 2 is less than a width of the rod 1 but greater than a width of the opening 14. A partition plate 12 extending lengthwise along the rod 1 is configured inside the hollow rod 1 to divide the hollow rod 1 into two chambers, they are an upper inner chamber 15 and a lower inner chamber 16 which is defined as the inner chamber 11. The rod 1 has two pairs of left and right ridges 13 respectively disposed at an upper inner wall and a lower inner wall of the lower inner chamber 16 each extending lengthwise along the rod 1. Each pair of the left and right ridges 13 is symmetrically disposed at two opposite sides of the opening 14, so as to position the lampshade 2 inside the inner chamber 11. Generally, the rod 1 has two edges 17 at a left side and a right side of the opening 14. The lampshade 2 has two small recesses 21 respectively formed at a left corner and a right corner of the bottom surface of the lampshade 2 for receiving and positioning the two edges 17 of the rod 1. Therefore, the lampshade 2 runs through the inner chamber 11 of the rod 1 and a bottom surface of the lampshade 2 is substantially flush with the rod 1. Two tube plugs are respectively connected to a front end and a rear end of the rod 1. The lampshade 2 and the rod 1 are mounted together to form a rod assembly 10.

The two light-emitting elements 5 are LED lamp beads. The LED lamp beads are disposed on two LED lamp boards 50 which are respectively disposed at the front end and a rear end of the light-guiding strip 3 and the two LED lamp boards 50 are electrically connected with each other. A connector 8 is connected to one of the two LED lamp boards 50 by a wire 7. The corresponding sealing plug 6 has a slot 62 for allowing the wire 7 to pass through. The light-emitting assembly 20 is electrically connected to an external power source through the connector 8. Each sealing plug 6 has a plug board 63 to be inserted into the hollow lampshade 2. Each sealing plug 6 has a glue injection groove 61 at a bottom of the sealing plug 6. After the two sealing plugs 6 are respectively inserted into the front end and the rear end of the lampshade 2, the two sealing plugs 6 are sealed with the lampshade 2 by injecting glue. Thus, water vapor can be prevented from entering into the lampshade 2, so that it is more suitable for outdoor use.

Figure 6:
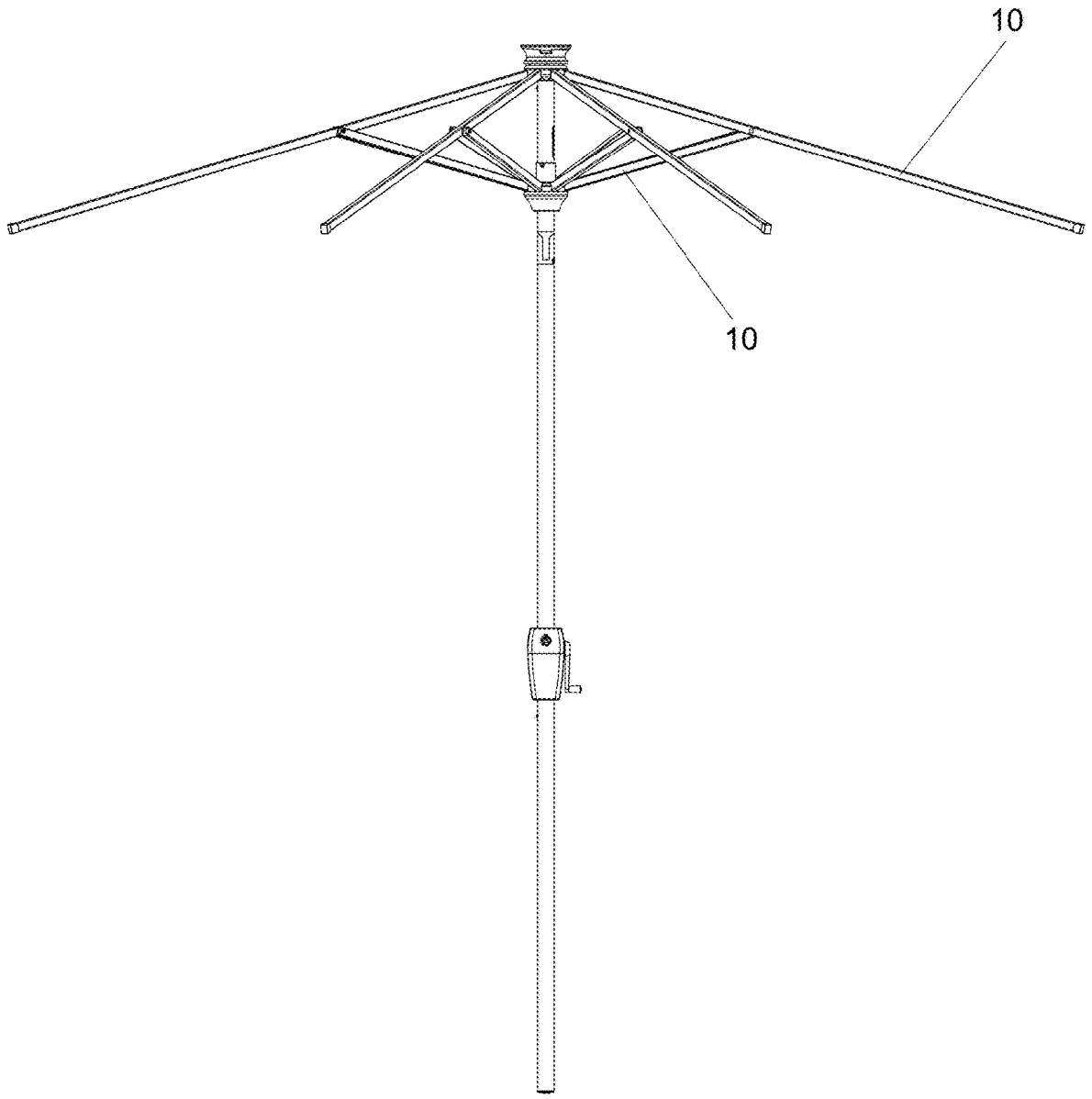
FIG. 6 is a perspective view of an upright umbrella having the rods of the present invention.
Figure 7:
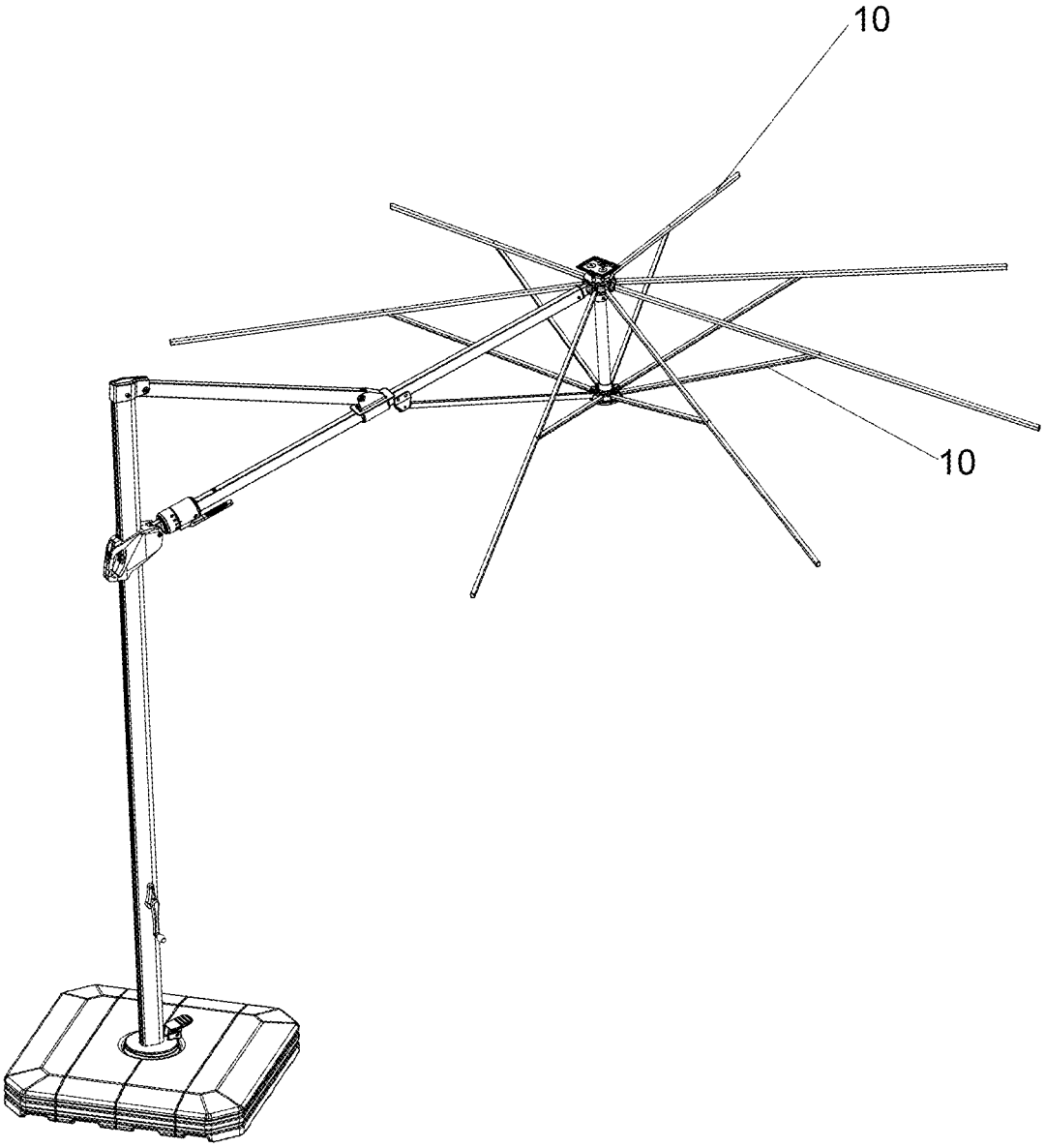
FIG. 7 is a perspective view of a cable-stayed umbrella having the rods of the present invention.
Figure 8:
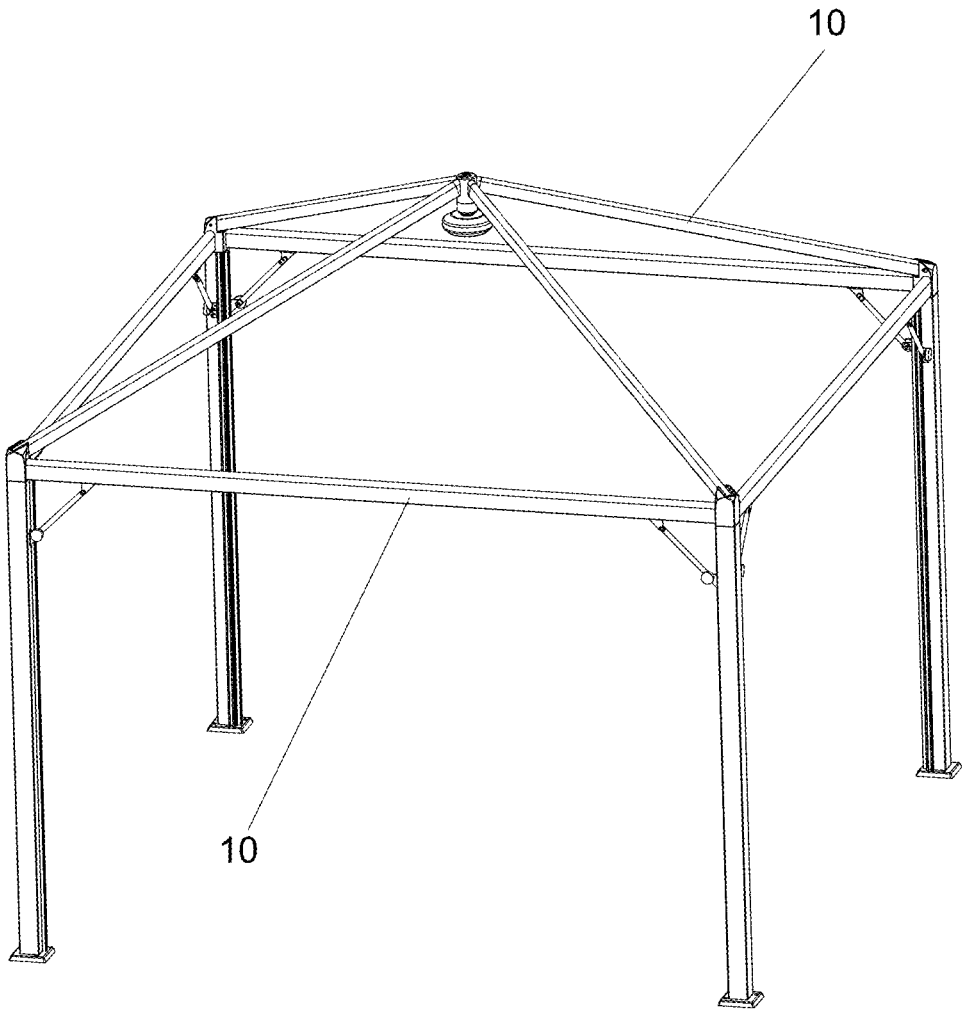
FIG. 8 is a perspective view of a canopy having the rods of the present invention.

The umbrella in this embodiment can be an upright umbrella as shown in FIG. 6, a cable-stayed umbrella in FIG. 7 or a canopy in FIG. 8.

During assembling, the assembled light-emitting assembly 20 is inserted into the lampshade 2 from an opening of the lampshade 2 and then fixed. The wire 7 and the connector 8 extend out of the front end of the lampshade 2. Two sealing plugs 6 are respectively disposed at the front end and the rear end of the lampshade 2, so that a lampshade assembly is assembled. Then, the assembled lampshade assembly is inserted into the inner chamber 11. Finally, two tube plugs are respectively connected to the front end and the rear end of the rod 1. Since the width of the opening 14 at the bottom of the inner chamber 11 is less than a width of the lampshade assembly, so that the lampshade assembly is firmly fixed in the inner chamber 11 and will not fall off.

When in use, light emitted by the LED lamp beads of the light-emitting elements 5 is transmitted by the light-guiding strip 3, then reflected by the reflective film 4 and diffused by the lampshade 2, and uniformly illuminated from a bottom surface of the lampshade 2, with good lighting effect and aesthetic appearance.

Embodiment 2

Figure 5:
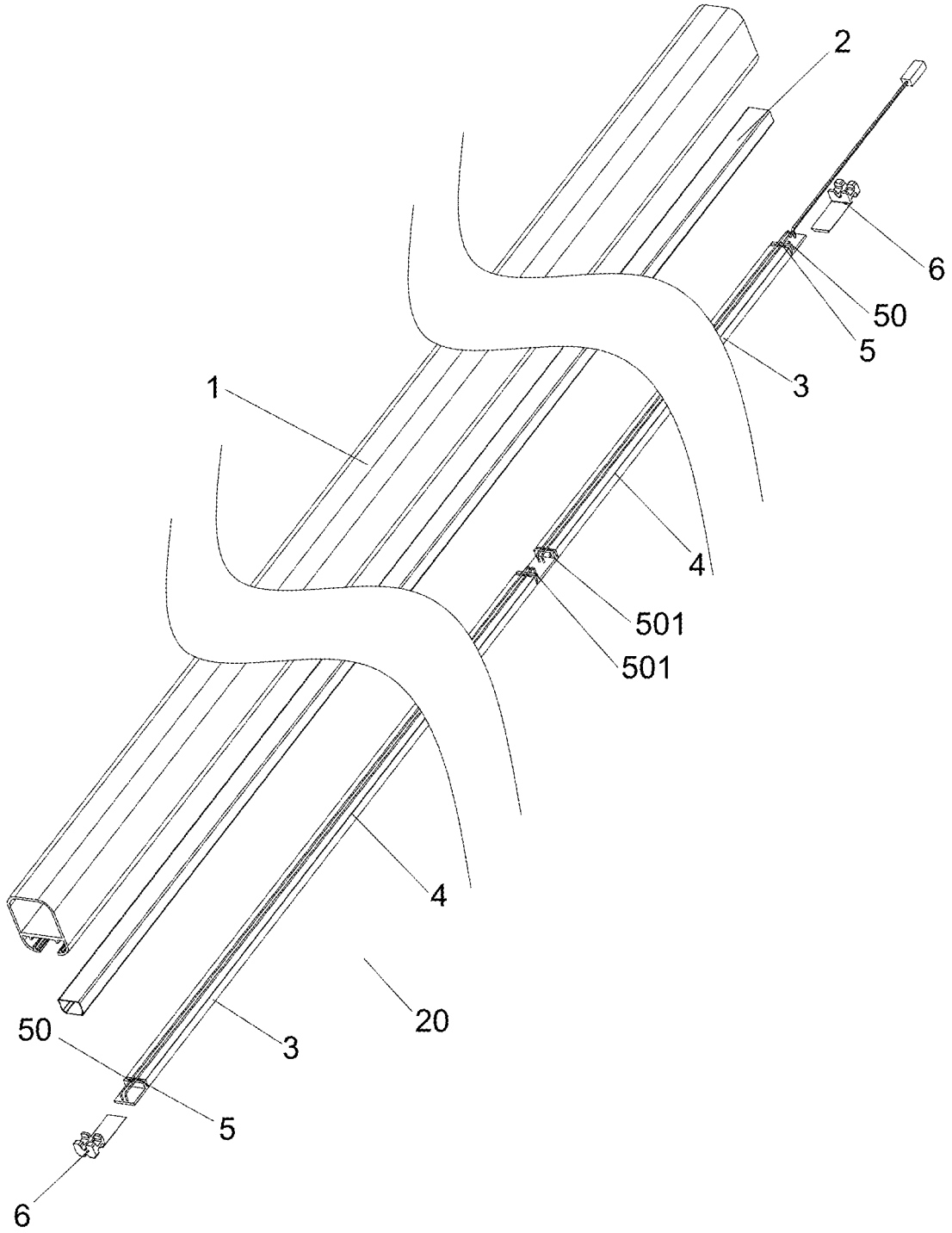
FIG. 5 is an exploded view of a rod with a light mechanism according to Embodiment 2 of the present invention.

As shown in FIG. 5, the umbrella having the rods each with the light mechanism comprises a column, one or more nests and a plurality of rods 1. Each rod with a light mechanism comprises a hollow rod 1, a hollow lampshade 2 and a light-emitting assembly 20. This embodiment differs from Embodiment 1 in that: there are two sets of light-guiding strips 3 and two reflective films 4. The two light-guiding strips 3 are sequentially disposed inside the lampshade 2 each extending lengthwise along the lampshade 2. Each reflective film 4 is attached to a back surface of the corresponding light-guiding strip 3. Of course, there may also be one reflective film 4 which is attached to the back surfaces of the two light-guiding strips 3, achieving similar effects. The number of the light-emitting elements 5 is four. The four light-emitting elements 5 are LED lamp beads. The LED lamp beads are disposed on two LED lamp boards 50 which are respectively disposed at the front end and a rear end of each light-guiding strip 3. Each LED lamp board 50 comprises a front lamp board 502, a middle lamp board 501 and a rear lamp board 503. Two light-emitting elements 5 located between the two light-guiding strips 3 are disposed at the same middle lamp board 501, the front lamp board 502 is electrically connected to the middle lamp board 501 by wiring, and the middle lamp board 501 is electrically connected to the rear lamp board 503 by wiring.

Since the light-emitting elements 5 are additionally disposed at a middle portion of each light-guiding strip 3, the lighting brightness is improved, and the lighting effect is better.

The umbrella in this embodiment can be an upright umbrella as shown in FIG. 6, a cable-stayed umbrella in FIG. 7 or a canopy in FIG. 8.

The protection scope of the present invention is not limited to each embodiment described in this description. Any changes and replacements made on the basis of the scope of the present invention patent and of the description shall be included in the scope of the present invention patent.

The invention claimed is:

1. A rod with a light mechanism, comprising:

a hollow rod;

a hollow lampshade having a front end and a rear end;

a light-emitting assembly running through the lampshade; and two sealing plugs respectively disposed at the front end and the rear end of the lampshade;

wherein, the rod has an inner chamber for receiving the lampshade, the rod has an opening at a bottom of the inner chamber extending lengthwise along the rod and allowing light of the light-emitting assembly to emit;

the light-emitting assembly comprises two light-emitting elements, a reflective film and a light-guiding strip, the reflective film is attached to a back surface of the light-guiding strip, the two light-emitting elements are respectively disposed at the front end and the rear end of the light-guiding strip, the two light-emitting elements are LED lamp beads, the LED lamp beads are disposed on two LED lamp boards which are respectively disposed at the front end and a rear end of the light-guiding strip, the two LED lamp boards are electrically connected with each other;

a connector is connected to one of the two LED lamp boards by a wire;

the corresponding sealing plug has a slot for allowing the wire to pass through, each sealing plug has a plug board to be inserted into the hollow lampshade;

each sealing plug has a glue injection groove at a bottom of the sealing plug;

after the two sealing plugs are respectively inserted into the front end and the rear end of the lampshade, the two sealing plugs are sealed with the lampshade by injecting glue.

2. The rod of claim 1, wherein the lampshade is of a strip shape, a width of the lampshade is less than a width of the rod but greater than a width of the opening;

a partition plate extending lengthwise along the rod is configured inside the hollow rod to divide the hollow rod into an upper inner chamber and a lower inner chamber which is defined as the inner chamber;

the rod has two pairs of left and right ridges respectively disposed at an upper inner wall and a lower inner wall of the lower inner chamber each extending lengthwise along the rod, so as to position the lampshade inside the inner chamber;

the lampshade runs through the inner chamber of the rod and a bottom surface of the lampshade is substantially flush with the rod, the lampshade and the rod are mounted together to form a rod assembly.

3. The rod of claim 2, wherein the rod has two edges at a left side and a right side of the opening, the lampshade has two small recesses respectively formed at a left corner and a right corner of the bottom surface of the lampshade for receiving and positioning the two edges of the rod.

4. The rod of claim 2, wherein a longitudinal section of the lampshade is of a rectangular shape, each pair of the left and right ridges is symmetrically disposed at two opposite sides of the opening.

5. The rod of claim 1, wherein there are at least two sets of the light-guiding strips and the two light-emitting elements.

6. The rod of claim 5, wherein the light-emitting assembly has two sets of the light-guiding strips and the two light-emitting elements, the number of the reflective film is one or two;

the two light-guiding strips are sequentially disposed inside the lampshade each extending lengthwise along the lampshade, the reflective films are attached to the back surfaces of the two light-guiding strips, the light-emitting elements are respectively disposed at the front and rear ends of each light-guiding strip;

each LED lamp board comprises a front lamp board, a middle lamp board and a rear lamp board, two light-emitting elements located between the two light-guiding strips are disposed at the same middle lamp board, the front lamp board is electrically connected to the middle lamp board by wiring, and the middle lamp board is electrically connected to the rear lamp board by wiring.

7. The rod of claim 1, wherein the rod is formed by extrusion molding of a hollow metal tube, two tube plugs are respectively connected to a front end and a rear end of the rod, the lampshade matches with the rod in length.

8. An umbrella, comprising a column, one or more nests and a plurality of rods;

wherein each rod has the light mechanism of claim 1.

9. An umbrella, comprising a plurality of supporting columns and a plurality of rods together forming a canopy frame;

wherein each rod has the light mechanism of claim 1.

* * * * *